US010450168B2

(12) United States Patent
Chaudhry et al.

(10) Patent No.: US 10,450,168 B2
(45) Date of Patent: Oct. 22, 2019

(54) DOUBLE DECK ELEVATOR SYSTEM

(71) Applicant: OTIS ELEVATOR COMPANY, Farmington, CT (US)

(72) Inventors: Zaffir A. Chaudhry, South Glastonbury, CT (US); Enrico Manes, Feeding Hills, MA (US); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/871,237

(22) Filed: Jan. 15, 2018

(65) Prior Publication Data

US 2019/0218065 A1 Jul. 18, 2019

(51) Int. Cl.
*B66B 11/02* (2006.01)
*B66F 7/06* (2006.01)

(52) U.S. Cl.
CPC ..... *B66B 11/022* (2013.01); *B66F 7/0666* (2013.01)

(58) Field of Classification Search
CPC ..... B66B 11/022; B66B 11/0213; B66B 2201/306; B66B 2201/307; B66B 2201/308; B66F 7/065; B66F 7/0658
See application file for complete search history.

(56) References Cited

U.S. PATENT DOCUMENTS

| | | | | |
|---|---|---|---|---|
| 5,907,136 | A * | 5/1999 | Hongo | B66B 1/42 187/249 |
| 6,334,511 | B1 | 1/2002 | Araki | |
| 6,802,396 | B2 | 10/2004 | Naitoh | |
| 7,090,056 | B2 | 8/2006 | Fujita et al. | |
| 9,033,110 | B2 | 5/2015 | Husmann | |
| 9,174,822 | B2 | 11/2015 | Cortona et al. | |

FOREIGN PATENT DOCUMENTS

| | | | | |
|---|---|---|---|---|
| CN | 101439823 | A | 5/2009 | |
| CN | 105668386 | A | 6/2016 | |
| CN | 106744190 | A | 5/2017 | |
| JP | 10236753 | A * | 9/1998 | B66B 11/022 |
| JP | 2001322771 | A | 11/2001 | |
| JP | 2002362858 | A | 12/2002 | |
| JP | 2003276967 | A | 10/2003 | |
| JP | 2004217412 | A | 8/2004 | |
| JP | 2005015135 | A | 1/2005 | |
| JP | 2016141552 | A | 8/2016 | |

* cited by examiner

*Primary Examiner* — Diem M Tran
(74) *Attorney, Agent, or Firm* — Carlson, Gaskey & Olds

(57) ABSTRACT

An illustrative example elevator assembly includes a frame having vertically oriented beams and horizontally oriented beams connected to the vertically oriented beams. A first elevator cab is supported within the frame between the vertically oriented beams. A pantograph linkage includes a plurality of links. The pantograph linkage is supported on one of the horizontally oriented beams. The pantograph linkage is connected with the first elevator cab such that different positions of the first elevator cab relative to the frame correspond to different relative positions of the links. A second elevator cab is suspended by the pantograph linkage beneath the frame. The different relative positions of the links place the second elevator cab in different positions relative to the frame.

20 Claims, 1 Drawing Sheet

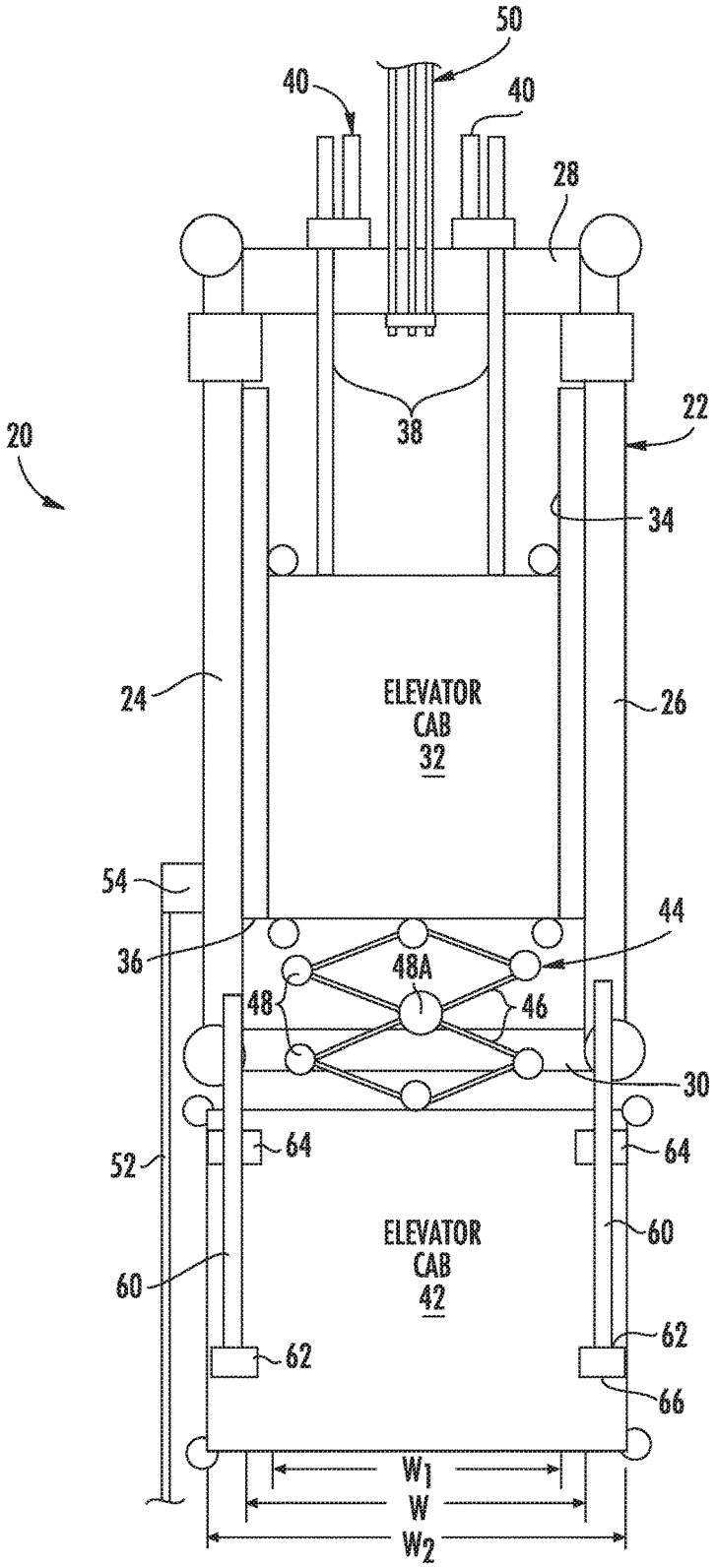
50
40
40
28
20
38
22
34
24
ELEVATOR
CAB
32
26
54
44
36
48A
48
46
30
52
64
64
ELEVATOR
CAB
42
60
60
62
62
66
W1
W
W2

DOUBLE DECK ELEVATOR SYSTEM

BACKGROUND

Elevator systems have proven useful for carrying passengers among various levels of buildings. Different building types present different challenges for providing adequate elevator service. Larger buildings that are more populated typically require increased elevator system capacity, especially at peak travel times. Different approaches have been suggested for increasing elevator system capacity.

One approach includes increasing the number of shafts or hoistways and elevator cars. This approach is limited because of the increased amount of building space required for each additional elevator. Another proposal has been to include more than one elevator car in a hoistway. Such arrangements have the advantage of increasing the number of cars without necessarily increasing the number of hoistways in a building. One of the challenges associated with systems having multiple cars in a single hoistway is maintaining adequate spacing between the cars and ensuring that they do not interfere with each other.

Another suggested approach has been to utilize a double deck elevator car in which two cabs are supported on a single frame in a manner that they both move in the elevator hoistway together. In some versions, the cabs can move relative to each other within the frame to adjust spacing between the cabs. Double deck elevators typically have heavier cars that require larger or more ropes, larger counterweights and larger motors. Each of these increase the cost of the system.

SUMMARY

An illustrative example elevator assembly includes a frame having vertically oriented beams and horizontally oriented beams connected to the vertically oriented beams. A first elevator cab is supported within the frame between the vertically oriented beams. A pantograph linkage includes a plurality of links. The pantograph linkage is supported on one of the horizontally oriented beams. The pantograph linkage is connected with the first elevator cab such that different positions of the first elevator cab relative to the frame correspond to different relative positions of the links. A second elevator cab is suspended by the pantograph linkage beneath the frame. The different relative positions of the links place the second elevator cab in different positions relative to the frame.

In an example embodiment having one or more features of the elevator assembly of the previous paragraph, the vertically oriented beams are separated by a horizontal distance. The first elevator cab has a first width in a horizontal direction that is smaller than the horizontal distance and the second elevator cab has a second width in the horizontal direction that is greater than the horizontal distance.

In an example embodiment having one or more features of the elevator assembly of any of the previous paragraphs, the pantograph linkage includes a plurality of pivots about which the links move into the different relative positions. One of the pivots is secured in a fixed position on the one of the horizontally oriented beams.

In an example embodiment having one or more features of the elevator assembly of any of the previous paragraphs, at least one vertical extension is situated at least partially beneath the frame. The at least one vertical extension includes a stop surface spaced from the frame. The second elevator cab includes a catch that is configured to contact the stop surface in the event that the second elevator cab moves downward relative to the frame a predetermined distance.

In an example embodiment having one or more features of the elevator assembly of any of the previous paragraphs, the pantograph linkage provides a desired range of movement of the second elevator cab beneath the frame. The predetermined distance corresponds to at least the desired range of movement.

In an example embodiment having one or more features of the elevator assembly of any of the previous paragraphs, the at least one vertical extension comprises a plurality of vertical extensions. Each of the vertical extensions includes a stop surface. The second elevator cab includes a corresponding plurality of catches.

In an example embodiment having one or more features of the elevator assembly of any of the previous paragraphs, the at least one vertical extension includes at least one buffer strike surface situated to selectively contact a buffer beneath the frame.

In an example embodiment having one or more features of the elevator assembly of any of the previous paragraphs, the at least one vertical extension is connected with at least one of the vertically oriented beams.

In an example embodiment having one or more features of the elevator assembly of any of the previous paragraphs, the at least one vertical extension comprises a plurality of vertical extensions. The vertical extensions are respectively connected to one of the vertically oriented beams. The vertical extensions are separated by a horizontal dimension corresponding to a horizontal spacing between the vertically oriented beams. The second elevator cab has a horizontally oriented width dimension that is greater than the horizontal dimension.

In an example embodiment having one or more features of the elevator assembly of any of the previous paragraphs, roping includes a plurality of elongated load bearing members that support a load of the frame and the elevator cabs and compensation roping has one end connected to the at least one vertical extension.

In an example embodiment having one or more features of the elevator assembly of any of the previous paragraphs, roping includes a plurality of elongated load bearing members that support a load of the frame and the elevator cabs and compensation roping has one end connected to the frame.

In an example embodiment having one or more features of the elevator assembly of any of the previous paragraphs, a plurality of threaded rods are supported by the frame and associated with the first elevator cab. At least one motor is configured to cause rotary movement of the threaded rods to move the first elevator cab into different positions relative to the frame.

In an example embodiment having one or more features of the elevator assembly of any of the previous paragraphs, the at least one motor comprises a plurality of motors. The plurality of motors includes one of the motors associated with a respective one of the threaded rods. The motors selectively cause rotary movement of the rods in a first direction to cause upward movement of the first elevator cab relative to the frame. The motors selectively cause rotary movement of the rods in a second, opposite direction to cause downward movement of the first elevator cab relative to the frame.

In an example embodiment having one or more features of the elevator assembly of any of the previous paragraphs, movement of the first elevator cab relative to the frame causes a change in the relative positions of the links and the change in the relative positions of the links causes movement of the second elevator cab relative to the frame.

In an example embodiment having one or more features of the elevator assembly of any of the previous paragraphs, the pantograph linkage causes movement of the second elevator cab simultaneous with movement of the first elevator cab. The simultaneous movement of the second elevator cab is in an opposite direction to the direction of movement of the first elevator cab.

Various features and advantages of at least one disclosed example embodiment will become apparent to those skilled in the art from the following detailed description. The drawing that accompanies the detailed description can be briefly described as follows.

BRIEF DESCRIPTION OF THE DRAWINGS

FIG. 1 schematically illustrates selected portions of an elevator system designed according to an embodiment of this invention.

DETAILED DESCRIPTION

FIG. 1 shows selected portions of an elevator assembly 20 including a frame 22 having vertically oriented beams 24 and 26 and horizontally oriented beams 28 and 30. A first elevator cab 32 is supported within the frame 22. The first elevator cab 32 is situated to follow along guiderails 34 and 36 so that the first elevator cab 32 is moveable into various positions relative to the frame 22.

In the illustrated example, threaded rods 38 are coupled to the elevator cab 32. Motor and gear assemblies 40 cause rotation of the threaded rods 38 to move the first elevator cab 32 relative to the frame 22. In this example, when the threaded rods 38 rotate in a first direction, the first elevator cab 32 moves upward relative to the frame 22. When the threaded rods 38 rotate in a second, opposite direction, the first elevator cab 32 moves in a downward direction relative to the frame 22.

A second elevator cab 42 is suspended beneath the frame 22. The second elevator cab 42 is supported by a pantograph linkage 44 that includes a plurality of links 46. A plurality of pivots 48 allow the links 46 to move relative to each other into different relative positions. In the illustrated example, one of the pivots 48A and associated structure of the pantograph linkage 44 is secured in a fixed position relative to the horizontally oriented beam 30. The pantograph linkage 44 and the frame 22 support the load of the second elevator cab 42.

The pantograph linkage 44 is coupled with the first elevator cab 32. As the first elevator cab 32 moves into different positions relative to the frame 22, the links 46 move into different relative positions. As the links 46 move relative to each other, the second elevator cab 42 moves relative to the frame 22. In the illustration, as the first elevator cab 32 moves upward, the second elevator cab 42 moves downward because the angles between adjacent links 46 increase and the pantograph linkage 44 becomes longer. Similarly, when the first elevator cab 32 moves downward relative to the frame 22, the second elevator cab 42 moves upward and closer to the frame 22 because the pantograph linkage becomes shorter (in a vertical direction).

One feature of having the second elevator cab 42 suspended beneath the frame 22 is that it reduces the amount of material required for the frame 22. This reduces the weight of the frame 22 and the overall weight of the assembly 20. Weight reductions in double deck elevator systems are beneficial because they reduce the requirements on the machine and the load bearing members of the roping assembly 50. Additionally, the counterweight (not illustrated) may be lighter, which also provides cost and space savings.

Another feature of having the second elevator cab 42 suspended beneath the frame 22 is that the elevator cab 42 can have an increased capacity compared to an elevator cab that is supported within the frame 22, such as the first elevator cab 32. In the illustrated example, the vertically oriented beams 24, 26 are separated by a horizontal spacing W between them. The horizontal width dimension $W_1$ of the first elevator cab 32 is smaller than the horizontal spacing dimension W. The second elevator cab 42, however, has a width dimension $W_2$ that is greater than W. This allows for the second elevator cab 42 to have an increased capacity, which improves the efficiency of the elevator system.

The example assembly 20 includes a compensation rope or chain 52 that is coupled with the frame 22 at 54. Securing a compensation rope or chain to the second elevator cab would alter the effect (e.g., tension) provided by the compensation rope when the second elevator cab 42 moves relative to the frame 22. Therefore, the compensation rope or chain 52 is secured to a portion of the assembly 20 to maintain a fixed length arrangement between the compensation rope or chain 52 and the load bearing members of the roping assembly 50.

The illustrated example embodiment includes vertically oriented extensions 60 secured to the frame 22. The extensions 60 each include a stop surface 62. The second elevator cab 42 includes catches 64 that are configured to contact the stop surfaces 62 if the second elevator cab 42 moves a corresponding distance away from the frame 22.

In some example embodiments, the stop surfaces 62 are situated so that the corresponding catches 64 will contact the stop surfaces 62 at the lowest position of the second elevator cab 42 provided by the pantograph linkage 44. In other examples, the stop surfaces 62 are situated below the lowest position of the catches 64 when the pantograph linkage 44 is fully extended for lowering the second elevator cab 42 to its furthest location spaced from the frame 22.

The vertically oriented extensions 60 and the stop surfaces 62 provide a back up support system in the event that the pantograph linkage 44 does not adequately support the second elevator cab 42. The catches 64 and the stop surfaces 62 are configured to be strong enough to support the weight of the second elevator cab 42 under such conditions.

The illustrated example includes at least one buffer strike surface 66 on at least one of the vertically oriented extensions 60 for contacting a buffer located beneath the assembly 20, such as a pit buffer at the bottom of a hoistway. The buffer strike surface 66 provides a rigid surface for contacting such a buffer instead of having a buffer strike the elevator cab 42, which is moveable relative to the frame 22.

The illustrated example embodiment provides weight and cost savings compared to other double deck elevator arrangements. Additionally, the manner in which the second elevator cab 42 is suspended beneath the frame allows for an increased passenger-carrying capacity of that elevator cab.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator assembly, comprising:

a frame having vertically oriented beams and horizontally oriented beams connected to the vertically oriented beams;

at least one vertical extension situated at least partially beneath the frame, the at least one vertical extension including a stop surface spaced from the frame;

a first elevator cab supported within the frame between the vertically oriented beams;

a pantograph linkage including a plurality of links, the pantograph linkage being supported on one of the horizontally oriented beams, the pantograph linkage being connected with the first elevator cab such that different positions of the first elevator cab relative to the frame correspond to different relative positions of the links; and a second elevator cab suspended by the pantograph linkage beneath the frame, the different relative positions of the links place the second elevator cab in different positions relative to the frame, the second elevator cab including a catch that is configured to contact the stop surface in the event that the second elevator cab moves downward relative to the frame a predetermined distance.

2. The elevator assembly of claim 1, wherein the vertically oriented beams are separated by a horizontal distance;

the first elevator cab has a first width in a horizontal direction that is smaller than the horizontal distance; and the second elevator cab has a second width in the horizontal direction that is greater than the horizontal distance.

3. The elevator assembly of claim 1, wherein the linkage assembly includes a plurality of pivots about which the links move into the different relative positions; and one of the pivots is secured in a fixed position on the one of the horizontally oriented beams.

4. The elevator assembly of claim 1, wherein the pantograph linkage provides a desired range of movement of the second elevator cab beneath the frame; and the predetermined distance corresponds to at least the desired range of movement.

5. The elevator assembly of claim 4, wherein the at least one vertical extension comprises a plurality of vertical extensions;

each of the vertical extensions includes a stop surface; and the second elevator cab includes a corresponding plurality of catches.

6. The elevator assembly of claim 1, wherein the at least one vertical extension includes at least one buffer strike surface situated to selectively contact a buffer beneath the frame.

7. The elevator assembly of claim 1, wherein the at least one vertical extension is connected with at least one of the vertically oriented beams.

8. The elevator assembly of claim 7, wherein the at least one vertical extension comprises a plurality of vertical extensions;

the vertical extensions are respectively connected to one of the vertically oriented beams;

the vertical extensions are separated by a horizontal dimension corresponding to a horizontal spacing between the vertically oriented beams; and the second elevator cab has a horizontally oriented width dimension that is greater than the horizontal dimension.

9. The elevator assembly of claim 1, comprising:

roping including a plurality of elongated load bearing members that support a load of the frame and the elevator cabs; and a compensation rope having one end connected to the at least one vertical extension.

10. The elevator assembly of claim 1, comprising:

roping including a plurality of elongated load bearing members that support a load of the frame and the elevator cabs; and a compensation rope having one end connected to the frame.

11. The elevator assembly of claim 1, comprising a plurality of threaded rods supported by the frame and associated with the first elevator cab; and at least one motor configured to cause rotary movement of the threaded rods to move the first elevator cab into different positions relative to the frame.

12. The elevator system of claim 11, wherein the at least one motor comprises a plurality of motors;

the plurality of motors includes one of the motors associated with a respective one of the threaded rods;

the motors selectively cause rotary movement of the rods in a first direction to cause upward movement of the first elevator cab relative to the frame; and the motors selectively cause rotary movement of the rods in a second, opposite direction to cause downward movement of the first elevator cab relative to the frame.

13. The elevator system of claim 12, wherein movement of the first elevator cab relative to the frame causes a change in the relative positions of the links; and the change in the relative positions of the links causes movement of the second elevator cab relative to the frame.

14. The elevator system of claim 13, wherein the pantograph linkage causes movement of the second elevator cab simultaneous with movement of the first elevator cab;

the simultaneous movement of the second elevator cab is in an opposite direction to the direction of movement of the first elevator cab.

15. An elevator assembly, comprising:

a frame having vertically oriented beams separated by a horizontal distance and horizontally oriented beams connected to the vertically oriented beams;

a first elevator cab supported within the frame between the vertically oriented beams, the first elevator cab having a first width in a horizontal direction that is smaller than the horizontal distance;

a pantograph linkage including a plurality of links, the pantograph linkage being supported on one of the horizontally oriented beams, the pantograph linkage being connected with the first elevator cab such that different positions of the first elevator cab relative to the frame correspond to different relative positions of the links; and a second elevator cab suspended by the pantograph linkage beneath the frame, the different relative positions of the links place the second elevator cab in different positions relative to the frame, the second elevator cab having a second width in the horizontal direction that is greater than the horizontal distance.

16. The elevator assembly of claim 15, comprising at least one vertical extension situated at least partially beneath the frame, wherein the at least one vertical extension includes a stop surface spaced from the frame; and the second elevator cab includes a catch that is configured to contact the stop surface in the event that the second elevator cab moves downward relative to the frame a predetermined distance.

17. The elevator assembly of claim 16, comprising:

roping including a plurality of elongated load bearing members that support a load of the frame and the elevator cabs; and a compensation rope having one end connected to the at least one vertical extension.

18. The elevator assembly of claim 15, comprising:

roping including a plurality of elongated load bearing members that support a load of the frame and the elevator cabs; and a compensation rope having one end connected to the frame.

19. The elevator assembly of claim 16, wherein the at least one vertical extension includes at least one buffer strike surface situated to selectively contact a buffer beneath the frame.

20. The elevator assembly of claim 16, wherein the at least one vertical extension is connected with at least one of the vertically oriented beams.

* * * * *